United States Patent [19]

Toge et al.

[11] Patent Number: 4,461,348

[45] Date of Patent: Jul. 24, 1984

[54] HEAT EXCHANGER

[75] Inventors: Hiroaki Toge, Oubu; Shinichi Esaka, Kariya; Yutaka Murakami, Nishio; Toshiaki Murao, Kariya, all of Japan

[73] Assignee: Nippondenso Co., Ltd., Kariya, Japan

[21] Appl. No.: 480,925

[22] Filed: Mar. 31, 1983

[30] Foreign Application Priority Data

Apr. 9, 1982 [JP] Japan ..... 57-51499[U]

[51] Int. Cl.[3] ..... F28D 9/02

[52] U.S. Cl. ..... 165/173; 165/149; 228/136; 228/183

[58] Field of Search ..... 165/148, 175, 176, 173, 165/149, 150, 79; 228/136, 183; 123/41.47, 198 C; 165/76

[56] References Cited

U.S. PATENT DOCUMENTS

| | | | |
|---|---|---|---|
| 4,324,290 | 4/1982 | Moranne | 165/173 |
| 4,331,201 | 5/1982 | Hesse | 165/173 |
| 4,378,174 | 3/1983 | Hesse | 165/173 |

FOREIGN PATENT DOCUMENTS

| | | | |
|---|---|---|---|
| 0028951 | 5/1981 | European Pat. Off. | 165/173 |
| 46-10646 | 3/1971 | Japan | 165/166 |

*Primary Examiner*—William R. Cline
*Assistant Examiner*—John F. McNally
*Attorney, Agent, or Firm*—Cushman, Darby & Cushman

[57] ABSTRACT

A heat exchanger of this invention used as a radiator for an automotive vehicle has a core plate having a holding groove around its periphery for receiving a seal member as well as a flange of a tank member, wherein a concave-convex portion is formed in the outer surface of the outer or inner side wall forming the holding groove. According to this structure, an excess molten solder is gathered toward the concave-convex portion when the core plate is heated for soldering in a heat furnace. This prevents the excess solder from making a drop-shaped mass which has an adverse influence on a seal efficiency of the seal member.

12 Claims, 24 Drawing Figures

HEAT EXCHANGER

BACKGROUND OF THE INVENTION

1. FIELD OF THE INVENTION

This invention relates to a heat exchanger, and more particularly it is concerned with a heat exchanger of the type having particular utility as a radiator dissipating heat from cooling water for engines of automotive vehicles, for example.

2. DESCRIPTION OF THE PRIOR ART

Generally, conventional radiators for automotive engines are composed of a core unit 4 having metallic tubes 2 and corrugated fins 3 connected with each other by welding in a heat transmitting manner, and an upper and a lower core plate 5 connected to both ends of the tubes 2 by welding, as shown in FIG. 1. Each of the core plates 5 is formed with a holding groove 6 along its periphery.

A soft seal member 7 such as O-ring is held in the holding groove 6, as shown in FIG. 2. And a flange 9 of a plastic tank member 8 is also held in the holding groove 6, so that the seal member 7 is interposed between a bottom wall **5*b* of the holding groove 6 and the flange 9**.

A plurality of hooks 10 integrally formed at equal intervals with an outer side wall **5*p* of the holding groove 6 are bent inwardly by a jig (not shown) so that the seal member 7 is compressed. Since a distance between a lower surface of the bottom wall 5*b* of the holding groove 6 and an upper surface of the bent hooks 10 is maintained constant by the jig, the compression ratio of the seal member 7 having a great influence on the seal efficiency between the tank member 8 and the core plate 5 is determined by a thickness h of the flange 9 and a thickness t of the core plate 5**.

The heat exchanger is made as follows. The tubes 2 coated with solder on their outer surface, corrugated fins 3 not coated with solder, and core plates 5 coated with solder on their outer surface, are assembled as shown in FIG. 1, and the assembled unit is carried into a furnace in order to melt the solder so as to weld each other. At this time overflow melting solder is gathered around the bottom wall **5*b*, outer side wall 5*p*, or hooks 10, as shown in FIG. 1, being in a form of drops 11**.

The heat exchanger of this kind, however, has following disadvantages; When the plurality of hooks 10 are bent by the jig, while the drop-shaped mass of the solder remains on those portions, the seal efficiency between the core plate 5 and the tank member 8 by the seal member 7 is deteriorated, because as shown in FIG. 3, there exist some portions where extra (over-flowed) solder 11 is attached and the seal member 7 in those portions are compressed more tightly than other portions. As above, the irregularity of compression ratio of seal member 7 reduces the seal efficiency. And since the portions at which the extra solder 11 is attached are stronger than the other portions, the bending force of the jig concentrates on the weak portions, the hooks 10 and the outer side wall **5*p* of the holding groove 6 of the weak portions are bent more as required, as shown in FIG. 4. This makes a relatively wide gap a between the hooks 10 and the flange 9 as well as a relatively wide gap b between the outer side wall 5*p* and the flange 9**, whereby the wall becomes rugged, which makes the life time of the radiator shorter.

SUMMARY OF THE INVENTION

In view of the above disadvantages of the prior art, the present invention has its object to provide a heat exchanger, wherein a seal member is regularly compressed and hooks of core plates are bent in a uniform fashion.

In order to provide the above heat exchanger, a concave-convex portion is formed in an outer surface of at least one of an outer side wall, an inner side wall of a holding groove and a hook.

According to this invention, since the concave-convex portion is formed in the outer surface of the side walls, soldering material is melted and flows toward the concave-convex portion when the heat exchanger is heated in a furnace, whereby it is prevented that the soldering material adheres to the core plate, that the thickness of the core plate becomes irregular, and that the compression ratio of the seal member becomes irregular. As a result, the sufficient seal efficiency can be ensured.

Furthermore, since the concave-convex portion is formed in the outer side wall and the height of the concave-convex portion is made the same as that of the outer side wall where the concave-convex portion is not formed, the outer side wall becomes rigid. Accordingly the rigidity of the outer side wall is higher than that of hooks.

This makes the bending operation of the hooks easier. Accordingly the hooks are bent just as predetermined.

DESCRIPTION OF THE PREFERRED EMBODIMENTS

Figure 1:
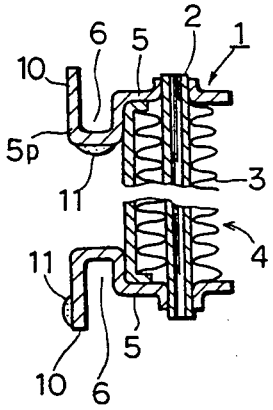
FIG. 1 (PRIOR ART)
FIG. 1 is a sectional view of a heat exchanger of the prior art.
Figure 2:
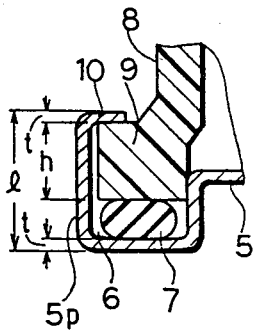
FIG. 2 (PRIOR ART)
FIGS. 2–4 are enlarged sectional views of the tank member and core-plate of the heat exchanger shown in FIG. 1.
Figure 3:
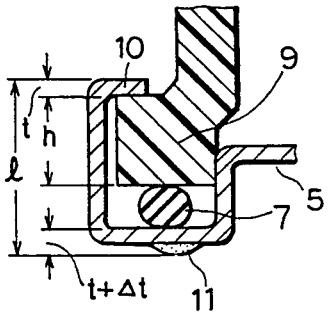
FIG. 3 (PRIOR ART)
Figure 4:
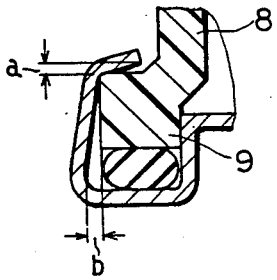
FIG. 4 (PRIOR ART)
Figure 5:
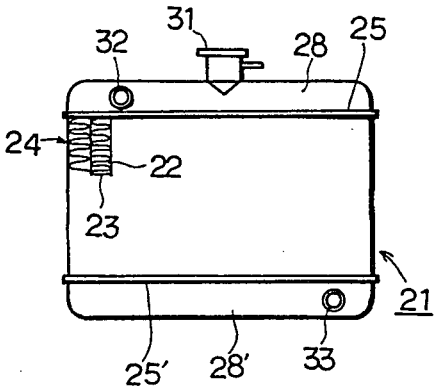
FIG. 5 is a front view of the heat exchanger of this invention.

FIG. 5 shows a front view of a heat exchanger according to one embodiment of the invention. In FIG. 5, numeral 21 designates a heat exchanger used as a radiator for an engine of an automotive vehicle. The heat exchanger 21 consists of a core unit 24, an upper and a lower core plate 25, and an upper and a lower tank member 28.

The core unit 24 comprises a plurality of flat tubes 22 made of aluminium and a plurality of corrugagted fins 23 made of aluminium and interposed between the flat tubes 24 and connected thereto in a heat transferring manner.

The upper and the lower core plates 25 are also made of aluminium and welded to both ends of the flat tubes 22. An upper and a lower plastic tank members 28 are fixed to the respective core plates 25 by a seal member 27 of an O-ring shape made of rubber, so that an upper and a lower tanks 34 are formed by the tank members 28 and the core plates 25, respectively.

The material of the tubes 22, the fins 23, and the core plates 25 may not be limited to aluminium. It is possible to use other metals instead of aluminium, brass for instance.

The upper tank member 28 is provided with an inlet port 31 and an inlet pipe 32, with which a connecting pipe is connected so that a cooling water flows from an engine thereinto. The lower tank member 28 is likewise provided with an outlet pipe 33 for draining the cooling water.

Figure 6:
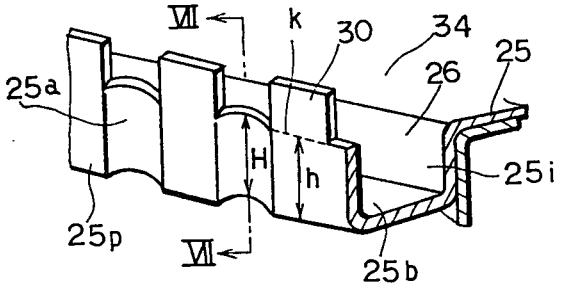
FIG. 6 is a perspective view of a part of the core-plate of the heat exchanger in FIG. 5.
Figure 7:
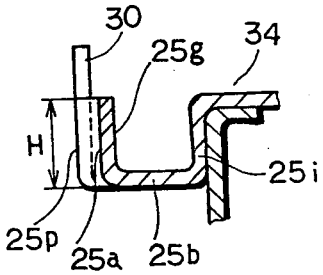
FIG. 7 is a sectional view taken along a line VII—VII in FIG. 6.

As shown in FIGS. 6 and 7, the core plate 25 is bent at its periphery to make an inner side wall **25*i*, a bottom wall 25*b* and an outer side wall 25*p* and to thereby form a holding groove 26. The core plate 25 has a plurality of hooks 30 extending from the outer side wall 25*p* at equal intervals. The outer surface of the side wall 25*p* is pressed inwardly between the portions from which the hooks 30 extend, to thereby form concave portions 25*a*. And an opposite surface (the inner surface) of the outer side wall 25*p* are formed elevated portions 25*g* protruding into the holding groove 26. The height H of the concaves 25*a* is made the same as that h of the outer side wall 25*p* where the concaves 25*a*** are not formed.

Figure 8:
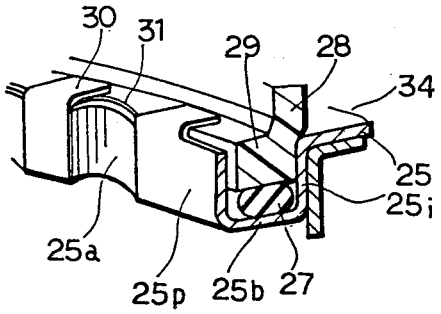
FIG. 8 is a perspective view of a part of the tank member and the core-plate of the heat exchanger in FIG. 5, and FIGS. 9 to 24 are, respectively, perspective views and sectional views taken along the corresponding lines.

The seal member 27 as well as a flange 29 of the tank member 28 is held in the holding groove 26, thereby to sandwich the seal member 27 between the bottom wall **25*b* of the holding groove 26 and the flange 29 as shown in FIG. 8. The flange 29 has depressed portions 31 for receiving the elevated portions 25*g* of the innersurface of the outer side wall 25*p*. The hooks 30 are bent inwardly by a jig (not shown) so that the seal member 27 is compressed between the upper surface of the bottom wall 25*b* and the lower surface of the flange 29 to ensure a seal between the core plate 25 and the tank member 28, as shown in FIG. 8**.

Since the concave **25*a* is formed in the outer surface of the outer side wall 25*p*, soldering material coated on the outer surface of the hooks 30, outer side wall 25*p* and bottom wall 25*b* is melted and flows toward the concave 25*a* by its surface tension when the core unit is heated in a furnace. Accordingly the soldering material, which does not work to weld the core plate 25 with tubes 22, is prevented from adhering to the outer side wall 25*p*, the bottom wall 25*b* or hooks 30. This makes the thickness of the core plate 25 uniform, and the compression ratio of the seal member 27** becomes likewise uniform.

Since the height H of the concaves **25*a* is made just as same as that h of the outer side wall, the rigidity (mechanical strength) of the outer side wall 25*p* is made higher than that of the hooks 30. Accordingly the hooks 30 are bent at a preferable line k (see FIG. 6) which is a bounding line between the hooks 30 and the outer side wall 25*p***.

Figure 9:
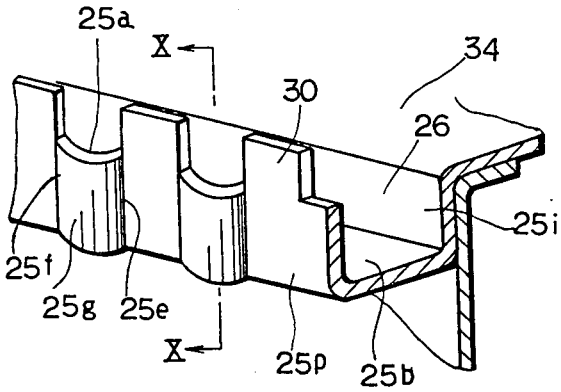
Figure 10:
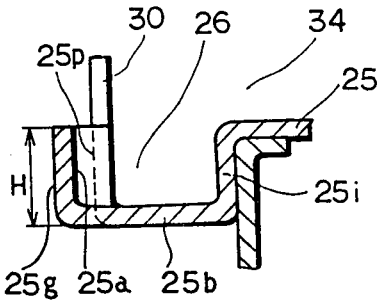

FIGS. 9 and 10 show a modification of the invention and the same numeral therein designates the same or similar parts as that in the above described embodiment.

The core plate 25 of this modification has a plurality of convexes **25*g* in the outer surface of the outer side wall 25*p* and in particular between the respective adjacent hooks 30, so that depressed portions 25** *a* are formed in the opposite surface of the outer side wall **25*p*. The height H of the convex 25*g* is the same as that of the outer side wall 25*p* where the convex 25*g* is not formed so that the rigidity of the side wall 25*p* is increased whereby the hooks 30 can be bent exactly as required. Since curved connections 25*e* and 25*f*** *d*with the plane portion of the outer side wall **25*p* are made at both sides of the convexes 25*g*, the overflow melting solder gathers to the curved connections 25*e* and 25*f* by surface tension when the core unit 24 is heated in the furnace. The flange 29 may be provided with elevated portions to be engaged with the depressed portions 25*a***, if necessary.

Figure 11:
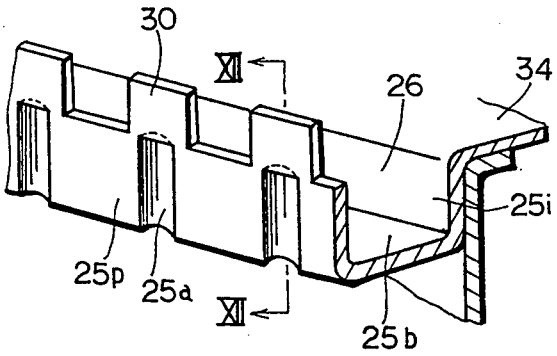
Figure 12:
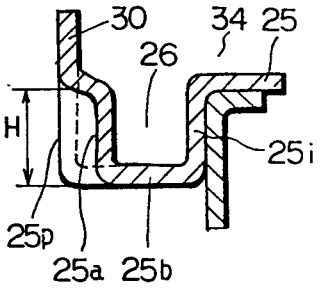
Figure 13:
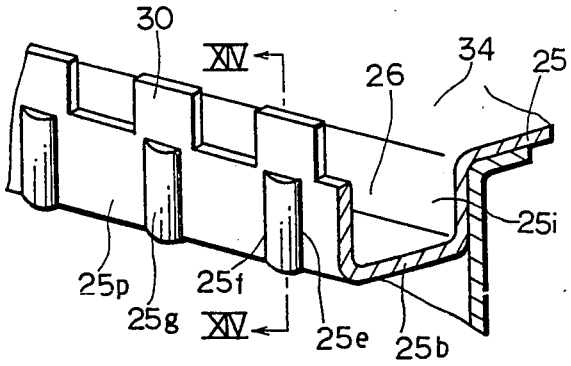
Figure 14:
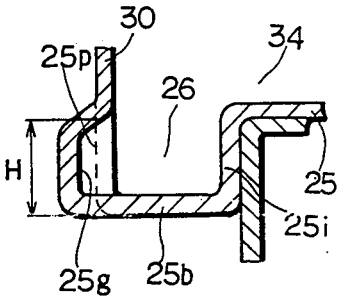
Figure 15:
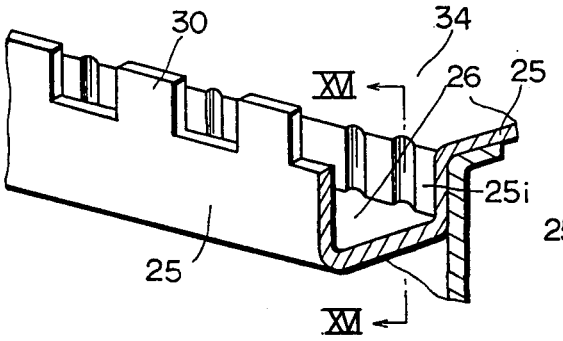
Figure 16:
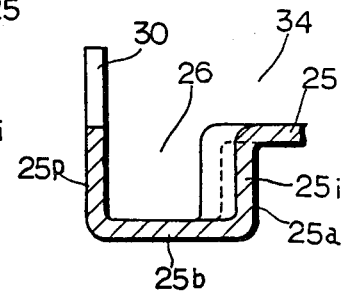
Figure 17:
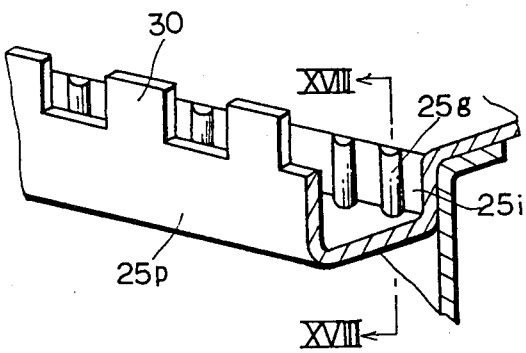
Figure 18:
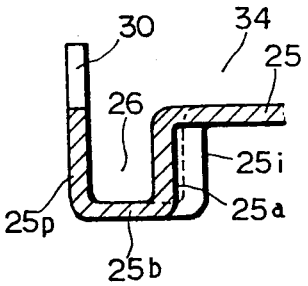
Figure 19:
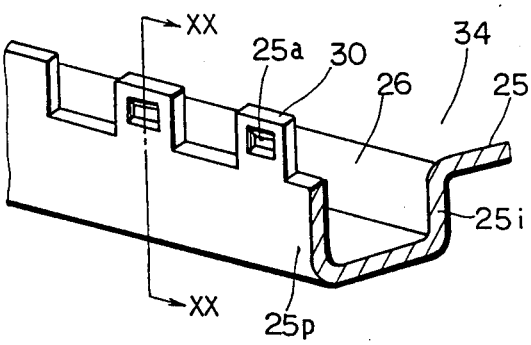
Figure 20:
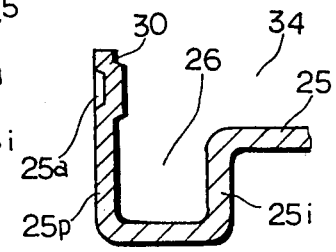
Figure 21:
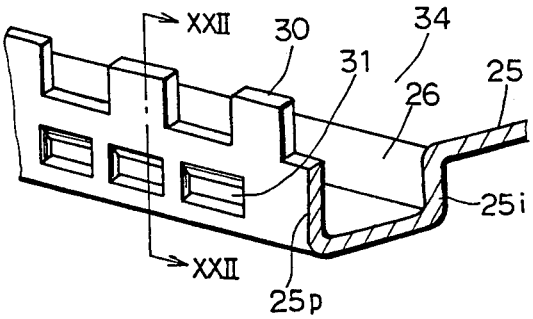
Figure 22:
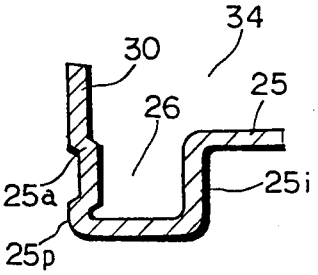
Figure 23:
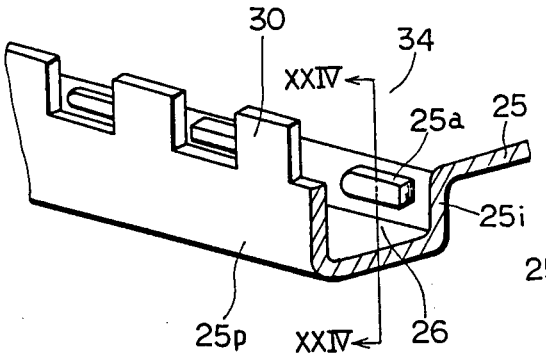
Figure 24:
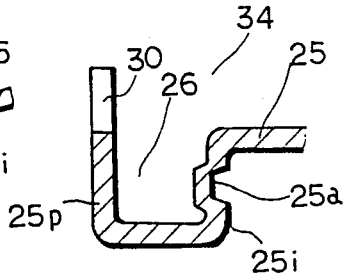

According to a further modification of the invention, concaves **25*a* (in FIGS. 11 and 12) or convexes 25*g* (in FIGS. 13 and 14) are formed in the outer surface of the outer side wall 25*p* in such a portion from which the hook 30** is extending.

Referring next to FIGS. 15 to 18, showing further modifications, convexes **25*g* (in FIGS. 15 and 16) or concaves 25*a* (in FIGS. 17 and 18) are respectively formed in the outer surface of the inner side wall 25*i*. Referring to FIGS. 19 to 24 showing further modifications of this invention, concaves 25*a* are so formed in the outer surface of one of the hooks 30 (in FIGS. 19 and 20), the outer side wall 25*p* (in FIGS. 21 and 22), and the inner side wall 25*i* (in FIGS. 23 and 24**), that its longitudinal axis is not vertical as in the above described embodiments but horizontal.

As explained above, a concave or a convex (referred to as a convex-concave portion in claims) is formed in an outer surface of either the inner side wall, the outer side wall or the hooks, and thereby excess molten solder flows into the concaves or towards curved connections with the plane portions of the side wall around the convex, when the core plate and the core unit are heated in order to solder the core plate, tubes and fins with one another. As a result a drop shaped mass of the solder can be prevented from being formed on such portions as bottom surface, the hook and so on. Accordingly a seal member in a holding groove can be always compressed with the same pressure.

When a concave or a convex is formed on the outer surface of the outer side wall and the height of the concave or convex is as same as that of side wall where the concave or convex is not formed, the rigidity (mechanical strength) can be enhanced.

What is claimed is:

1. A heat exchanger comprising;

a plastic tank member having a flange portion at its open end;

a core unit having tubes and fins connected with each other by soldering;

a core plate fixed to said core unit, said core plate having an inner side wall, a bottom wall and an outer side wall to thereby form a holding groove for receiving said flange portion, said core plate having also a plurality of hooks extending from said outer side wall, said hooks being bent over said flange portion to fix said tank member to said core plate; and a seal member disposed in said holding groove and between said bottom wall and said flange portion;

wherein the improvement comprises;

a concave-convex portion formed in an outer surface of at least one of said inner side wall, outer side wall and hook of a size such that the solder will be attached thereto by surface tension during said soldering to leave the core plate substantially solder free.

2. A heat exchanger as claimed in claim 1, wherein said concave-convex portion is a concave formed in the outer surface of said outer side wall.

3. A heat exchanger as claimed in claim 2, wherein said concave is formed in the outer surface of said outer side wall and between portions from which said hooks extend.

4. A heat exchanger as claimed in claim 2, wherein said concave is formed in the outer surface of a portion from which said hook extends.

5. A heat exchanger as claimed in claim 3, wherein the height of said concave is the same as that of said outer side wall where said concave is not formed.

6. A heat exchanger as claimed in claim 1, wherein said concave-convex portion is a concave formed in the outer surface of said inner side wall.

7. A heat exchanger as claimed in claim 1, wherein said concave-convex portion is a concave formed in the outer surface of said hook.

8. A heat exchanger as claimed in claim 1 wherein said concave-convex portion is a convex formed in the outer surface of said outer side wall.

9. A heat exchanger as claimed in claim 8, wherein said convex is formed in the outer surface of said outer side wall and between portions from which said hooks extends.

10. A heat exchanger as claimed in claim 8, wherein said convex is formed in the outer surface of a portion from which said hook extends.

11. A heat exchanger as claimed in claim 9, wherein the height of said convex is the same as that of said outer side wall where said convex is not formed.

12. A heat exchanger as claimed in claim 1, wherein said concave-convex portion is a convex formed in the outer surface of said inner side wall.

* * * * *